US005711527A

United States Patent [19]

Phalin et al.

[11] Patent Number: 5,711,527

[45] Date of Patent: Jan. 27, 1998

[54] PROJECTILE GAME AND METHOD OF GAME PLAYING

[76] Inventors: Todd M. Phalin; Karen J. Phalin, both of 1426 Austin Rd., Janesville, Wis. 53545

[21] Appl. No.: 820,011

[22] Filed: Mar. 18, 1997

[51] Int. Cl.[6] ..... A63F 67/00

[52] U.S. Cl. ..... 273/317.1; 273/269; 273/408

[58] Field of Search ..... 273/317.1, 403, 273/404, 408, 409, 269, 270, 348.4

[56] References Cited

U.S. PATENT DOCUMENTS

| | | | |
|---|---|---|---|
| 2,039,352 | 5/1936 | Ross . | |
| 2,303,573 | 12/1942 | Munro | 273/409 |
| 3,949,989 | 4/1976 | Van Meter | 273/348.4 |
| 5,066,020 | 11/1991 | Trudeau . | |
| 5,301,952 | 4/1994 | Fitzgerald | 273/269 |
| 5,377,990 | 1/1995 | Seeney-Sullivan . | |
| 5,505,459 | 4/1996 | Yiu | 273/408 |
| 5,558,337 | 9/1996 | Frank, III | 273/408 |
| 5,603,504 | 2/1997 | Powell | 273/348.4 |

FOREIGN PATENT DOCUMENTS 1 503 114 5/1976 United Kingdom .

*Primary Examiner*—William H. Grieb
*Attorney, Agent, or Firm*—DeWitt Ross & Stevens S.C.

[57] ABSTRACT

A game of projectile-throwing skill is disclosed which includes the steps of throwing a projectile toward a target by a player and marking with a marker a game card held by that player only the region on the target struck by the projectile which matches a corresponding region on that player's game card. This is repeated throughout the order of play, whereby patterns are formed on the players' game cards, until one player has formed a pre-selected pattern on his or her game card, thereby determining the winner of the game.

19 Claims, 4 Drawing Sheets

| Bull's Eye Bingo! | | | | |
|---|---|---|---|---|
| light 11 | 6 | 12 | 20 | 8 |
| 1 | dark 15 | 16 | 4 | 18 |
| 9 | 13 | B | 14 | 10 |
| 17 | 3 | 15 | light 6 | 2 |
| 7 | 19 | 11 | 5 | dark 19 |

Fig 3A

| Bull's Eye Bingo! | | | | |
|---|---|---|---|---|
| 6 | 12 | 20 | 8 | B |
| 1 | double 16 | 4 | B | 18 |
| 9 | 13 | B | 10 | 14 |
| 17 | B | 3 | 15 | double 2 |
| B | 7 | 19 | 11 | 5 |

Fig 3B

| Bull's Eye Bingo! | | | | |
|---|---|---|---|---|
| B | 6 | 12 | 20 | 8 |
| 1 | | | | 18 |
| 9 | | triple 20 | | 10 |
| 17 | | | | 2 |
| 7 | 19 | 11 | 5 | B |

Fig. 3C

| Bull's Eye Bingo! | | | | |
|---|---|---|---|---|
| | | 12 | | |
| | | 16 | | |
| 9 | 13 | B | 15 | 6 |
| | | 1 | | |
| | | 8 | | |

Fig. 3D

PROJECTILE GAME AND METHOD OF GAME PLAYING

FIELD OF THE INVENTION

The present invention is drawn to a projectile-throwing game which combines the skill elements of darts and the chance elements of bingo.

DESCRIPTION OF THE PRIOR ART

Games which incorporate various elements of conventional darts and bingo are described in the patent literature. For instance, Great Britain Patent Specification No. 1,503,114, published Mar. 8, 1978, describes a game which includes a dart board having 45 or 90 numbered, pie-shaped segments and marker boards which have numbers inscribed thereon, some of which correspond to the numbered segments on the dart board. As described, the game is played very similarly to conventional bingo: a player throws a dart at the dart board, and the dart becomes lodged in a given segment on the board. The number of the struck segment is announced, and the throwing player, as well as the non-throwing, "passive" players each mark the corresponding number on their marker boards if it is present.

Ross, U.S. Pat. No. 2,039,352, issued May 5, 1936, also describes a game which is played in the same fashion as bingo. Here, the dart board is shown as being square in configuration, and the playing cards are inscribed with corresponding subsets of the numbers which appear on the dart board. The game itself is played in the same fashion as the game described above: players take their turns throwing darts at the board and all of the players, both the player throwing the darts and the other, "passive" players, mark their playing cards accordingly.

Trudeau, U.S. Pat. No. 5,066,020, issued Nov. 19, 1991, describes a projectile-throwing game which incorporates the elements of a conventional 52-card deck of playing cards. The dart board includes variously colored "number" and "facecard"segments which correspond to the individual playing cards of a conventional deck of cards. Utilizing four different sets of darts representing the four suits in a deck of cards, the object of the game is to strike appropriate segments of the board which correspond to a winning hand of cards in a given card game, such as poker.

*Seeney-Sullivan*, U.S. Pat. No. 5,377,990, issued Jan. 3, 1995, describes a dart and marker game which incorporates Native American symbols. The Seeney-Sullivan game utilizes playing cards which correspond to the symbols on the dart board in order to record the spaces which have been hit and therefore do not need to be hit again.

None of the references described above is seen as anticipating or rendering obvious the present invention.

SUMMARY OF THE INVENTION

The invention is directed to a method of playing a game of skill and luck which comprises providing a target, the target having defined thereon a plurality of discrete, identified regions; a plurality of game cards, the game cards having defined thereon a plurality of discrete, identified regions, some or all of which correspond to the plurality of regions on the target; and at least one projectile and a means for marking regions on the game cards. Each player is then provided one or more game cards. An order of play is established from amongst the players, and a winning pattern to be formed by markers on the players' game cards is selected.

Play begins by having Player 1 throw the projectile at least once toward the target and marking on only Player 1's game card the region on the target struck by the projectile which matches the region on that player's game card (if any match exists). The number of projectiles thrown by each player during his or her turn is arbitrary and can be selected prior to the beginning of play by consensus of all the players; however, 3 to 5 throws per turn is preferred.

This process is repeated throughout the order of players. At each turn, the player throwing the projectiles has his or her game card only marked at any regions which correspond to the regions on the target hit by that player's projectiles only. Non-projectile throwing players do not mark their cards based upon the projectiles thrown by the other players. In this fashion, patterns are formed on the players' game cards. The process continues until one player has formed the winning pattern selected before the start of play by the marks on his or her game card. This player is declared the winner.

The benefits and advantages of this game of skill and luck will appear more fully from a complete reading of the Detailed Description of the Invention, the claims, and the accompanying drawing figures, below.

BRIEF DESCRIPTION OF THE DRAWINGS

FIG. 3A is a representative game card for use in playing the game of the invention.

FIG. 3B is another representative game card for use in playing the game of the invention.

FIG. 3C is yet another representative game card for use in playing the game of the invention.

FIG. 3D is a further representative game card for use in playing the game of the invention.

DETAILED DESCRIPTION OF THE INVENTION

Figure 1:
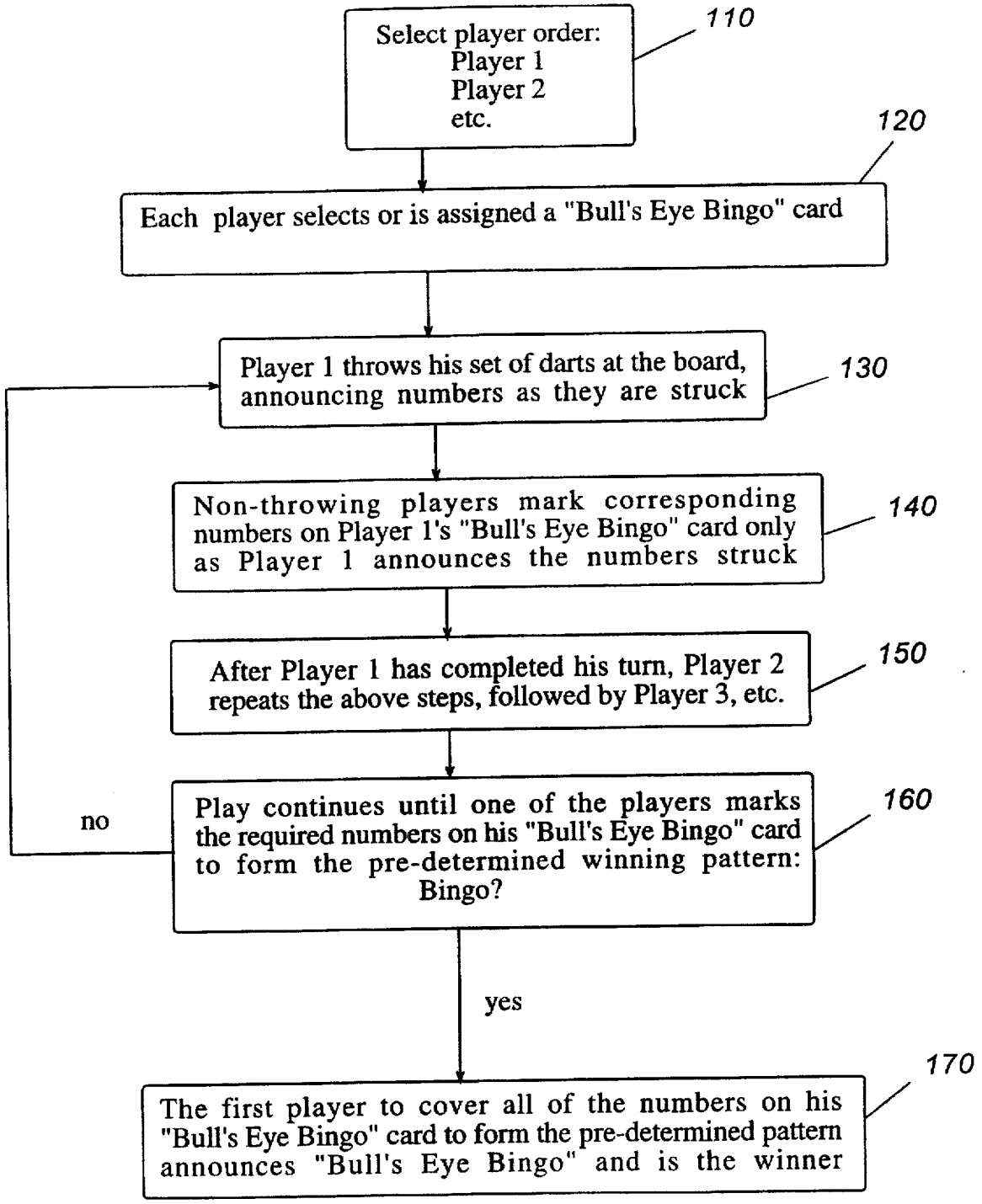
FIG. 1 is a flow chart depicting the method of playing the projectile game according to the present invention.

Referring now to the attached drawing figures, FIG. 1 depicts a flow chart which illustrates how the present game is played. At box 110, the order in which the players take their turns is selected. This can be done by any suitable means. Methods of chance for selecting player order include a roll of a die (highest or lowest number going first), a flip of a coin, "rock, paper, scissors", and the like. Methods of skill for selecting player order include allowing each player a single throw of a projectile toward a selected region on the target, the order of play corresponding to the distance of each player's projectile from the selected target.

At box 120, the players select or are assigned a game card (a "Bull's Eye Bingo!" card). Various types of game cards are depicted in FIGS. 3A through 3D, described below. It is also at this time that the players select a winning pattern to be marked on the game card in order to win the game. The winning pattern selected in order to win the game can be any pattern desired by the players. Typical patterns include five adjacent regions on the game card, the five adjacent regions defining a horizontal, vertical, or diagonal line, or a pattern in which all regions on the game card adjacent to its periphery have been marked. Other patterns included centered or off-centered crosses, clovers, a11 four corners, and the like.

At box 130, Player 1 throws one or more projectiles at the target, announcing the regions struck. Corresponding regions on Player 1's game card, and Player 1's game card only, are marked. In order to encourage player participation and continuity, it is preferred that the other, non-throwing players mark the throwing players' game card, as noted in box 140. This allows the throwing player to concentrate on the target, and also quickens the pace of the game. Marking the game cards can be done by any suitable means for marking. If disposable game cards are used, the game cards can be marked by pencil, pen, crayon, and the like. If nondisposable game cards are used, any suitable removable marker such as disks, chips, magnetic means for marking, removable stickers, and the like may be used.

After Player 1 has completed throwing his allotment of projectiles, Player 2 throws his allotment of darts, followed by the remaining players, as shown in box 150.

Play continues until one of the players marks the required regions on his or her game card to define the winning pattern selected before the beginning of play, as shown in box 160. The player who first completes the winning pattern shouts "Bull's Eye Bingo!" and is declared the winner. This is depicted in box 170 of FIG. 1.

Figure 2:
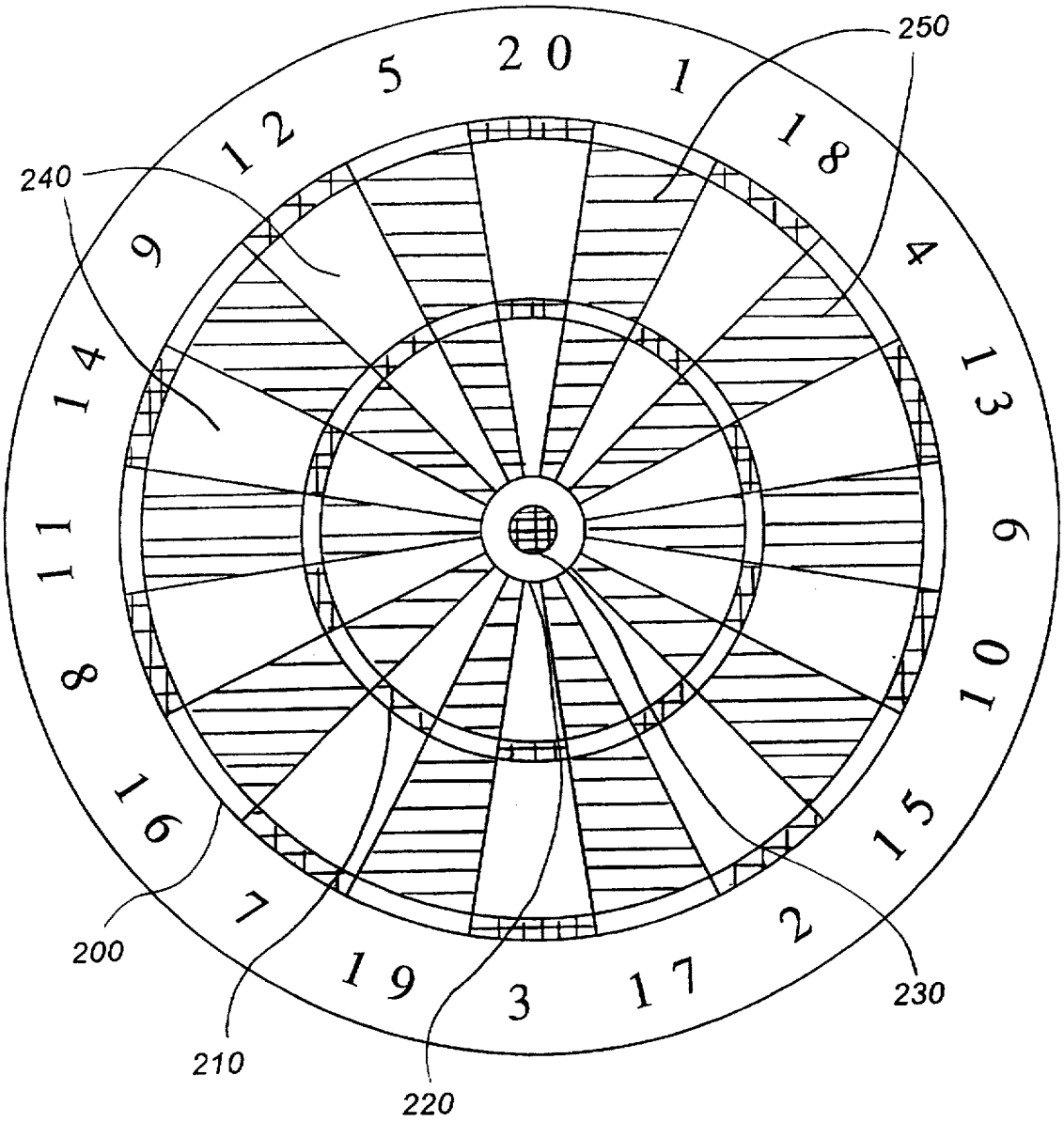
FIG. 2 is a depiction of a standard "20-section" dart board target which can be used in playing the game of the present invention.
Figure 4A:
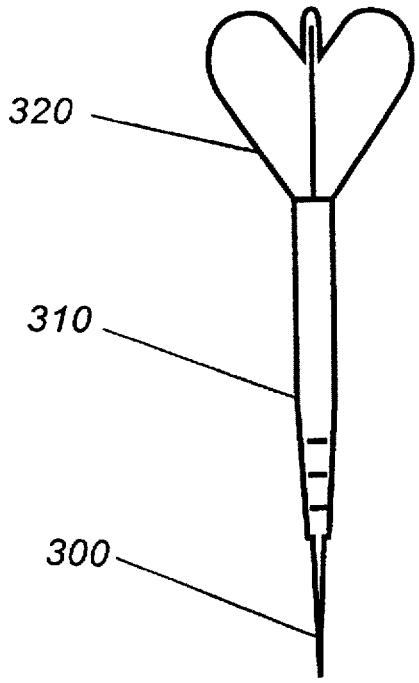
FIG. 4A is a depiction of a projectile suitable for use in playing the game of the present invention.
Figure 4B:
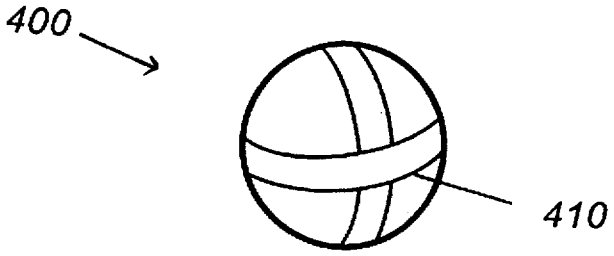
FIG. 4B is a depiction of a different projectile equally suitable for use in playing the game of the present invention.

A preferred target and projectiles which can be used in the game are depicted in FIGS. 2, 4A, and 4B, respectively. The target illustrated in FIG. 2 is a conventional, 20-segment dart board. The board includes twenty wedge-shaped, numbered regions defining a circle (numbered within the figure itself as numerals 1–20), a doubling region 200 and a tripling region 210 intersecting each of the wedge-shaped numbered regions, an outer bull's eye 220 disposed at the center of the circle defined by the wedge-shaped numbered region, and an inner bull's eye 230 inscribed within the outer bull's eye. Additionally, the regions defined between the outer bull's eye, the tripling region, and the doubling region alternate in color so as to define "light" regions 240 and "dark" regions 250. In practice, the light and dark regions are colored in two easily distinguishable hues, such as black and yellow or any other suitable two-color combination.

The dart board shown in FIG. 2 is preferred due to its ubiquity world-wide. However, any type of target will function with equal success so long as corresponding game cards are made available to the players.

The target may be fabricated from materials suitable for use with metal-tipped darts. Conventionally, such targets are manufactured from hog bristle which allows metal-tipped projectiles to easily penetrate the target. However, any material, synthetic or natural, of equivalent functionality is suitable.

The target may also be fabricated so as to be used with plastic-tipped "safety"or "bar" darts. These projectiles include a flexible tip which will not easily injure a participant or bystander if haphazardly thrown. In this case, the target shown in FIG. 2 is generally fabricated from a rigid material in the form of a web having a plurality of equally-spaced apertures passing therethrough. The size of the apertures is such that the flexible tip of the projectile will pass through the apertures and form a friction engagement which holds the projectile to the target. This type of target may also include automatic means for tracking the progress of the game, the current player to be throwing, the number of rounds which have been played, as well as any other game parameters. Such means are well known and widely employed.

The target may also be fabricated for use with hook-and-eye type fasteners, such as "VELCRO" brand fasteners. In this embodiment, either the target or the projectile is covered with the "hooks" while the other is covered with the "eyes."When the projectile makes contact with the target, the "hooks" engage the "eyes"whereby a releasible attachment between the projectile and the target is established.

The projectile shown in FIG. 4A is a dart. The dart includes a tip 300, a shaft 310, and fletching 320. The tip 300 may be a metal tip or a flexible tip, as described above.

The projectile shown in FIG. 4B is for use with hook-and-eye type fasteners and is more suitable for game playing by younger children. Here, the projectile is a ball 400 which includes the "hooks" or "eyes" of a hook-and-eye type fastener 410 disposed about two equators of the ball.

FIGS. 3A, 3B, 3C, and 3D show representative samples of game cards which can be used in conjunction with the target shown in FIG. 2. The game cards include subsets of the numbers 1–20 which appear on the target. Additionally, the game cards can include "light" or "dark" designations as shown in FIG. 3A. In order to mark the region designated "light 11" on the game card depicted in FIG. 3A (upper left-hand corner), a player must not only hit the designated number "11", but must hit the numbered region in an area of the designated color. Referring back to FIG. 2, region "11" appears at the 9 o' clock position on the target. The light regions of "11"correspond to the doubling and tripling regions of "11," thereby making the "light 11" region more difficult to hit than the unrestricted "11" region, which can be marked by hitting any are within region "11." In contrast, the "dark 19" region of the game card shown in FIG. 3A corresponds to a much larger region on the target shown in FIG. 2 (region "19" is at the 6:30 o'clock position of the target).

More difficult still to strike are the regions designated "double 16" or "triple 20" as shown in FIGS. 3B and 3C, respectively. These regions can be scored only when a single sub-region within the numbered region on the target is hit. This is in contrast to the "light 11" region shown in FIG. 3A. The "light 11" region can be marked when either the doubling sub-region or the tripling sub-region of region "11"is hit. However, to score the "double 16" on the game card shown in FIG. 3B, the doubling sub-region of region "16" must be hit. To score the "triple 20" region of the card shown in FIG. 3C, the tripling sub-region of region "20" must be hit.

All of the cards shown in FIGS. 3A through 3D include a region designated "B"for bull's eye, the center region of the target shown in FIG. 2. The definition of what constitutes a bull's eye may be assigned differently depending upon the skill level of the various players. For a beginner or more novice player to mark a bull's eye on his or her game card, that player must hit either the inner or outer bull's eye. For a more advanced player, however, only striking the inner bull's eye will enable that player to score the "B" on his or her card. This aspect maintains the challenge of the game for all players, without making the game overly difficult for beginners.

FIGS. 3C and 3D also serve to illustrate representative patterns which can be used as winning patterns. Normally, all of the regions of the game cards include numbered designations. Several of the regions in the game cards depicted in FIGS. 3C and 3D have been left blank to illustrate a "periphery and center" pattern (FIG. 3C) and an "iron cross" pattern (FIG. 3D). Other patterns can be easily envisioned.

Having described the equipment used in the game and the method of play, several advantages of the game are immediately apparent.

Notably, the game is designed to be more a game of skill than a game of chance. In the prior art games, all of the players mark their game cards according to the projectiles thrown by all of the other players. Consequently, a player may unwittingly win the game for another player by inadvertently striking that region of the target required by the other player to complete the winning pattern on his or her game card. This significantly reduces the level of skill required to win the games described in the prior art.

In contrast, in the present game, a player marks his or her game card according only to the projectiles thrown by him or her. Consequently, winning the game is almost entirely a function of the projectile-throwing skill of the individual players. Some element chance is involved, of course, because a player may inadvertently strike a region on the target which also appears on his or her game card, even though the player was not intending to hit that region. Such an inadvertent strike does not, however, ever work to the throwing player's disadvantage in the present game because only the throwing player's game card is marked at each turn.

Another distinct advantage of the game which is not described in the prior art is the provision for allowing the other players to assign a given player a game card. The advantage in allowing the other players to assign an individual player a game card is that it allows the game to be handicapped. As noted above, in the prior art games, all of the players mark their respective cards according to the regions struck by all of the players. For example, if Player 1 hits region "3" of the target shown in FIG. 2, all of the players will mark any corresponding "3's" on their game cards. This aspect of the prior art games works against novice players who are unable guide the projectiles toward the intended target as skillfully as advanced players. In the prior art games, errant projectiles thrown by novice players are marked on the playing cards of novice and advanced players alike.

To illustrate this advantage of the present game, if Player i is a beginning player, Player 1 can select or be assigned a playing card such as the card depicted in FIG. 3A. The playing card shown in FIG. 3A includes only a single "bull's eye"("B") in the center square, along with four "light" and "dark" targets along one diagonal. Using this card, if the pre-determined winning pattern is five regions in a row, horizontally, vertically, or diagonally, Player 1 can win the game in eight different combinations in either the horizontal or vertical directions without ever having to hit a "bull's eye."

If Player 2 in the same game is an accomplished player, Player 2 can select or be assigned a playing card such as the card depicted in FIG. 3B. This card includes five "bull's eyes" running along one diagonal. With the pre-determined winning pattern set at five squares in a row, horizontally, vertically, or diagonally, Player 2 must hit at least one "bull's eye" in order to win the game. This feature of the invention allows novice and intermediate players to engage in an evenly-matched game with advanced players, while still challenging the projectile-throwing skills of all of the players.

It is understood that the invention is not confined to the particular projectiles, targets, and game cards herein illustrated and described, but embraces all such modified forms thereof as come within the scope of the following claims.

What is claimed is:

1. A method of playing a game comprising:

(a) providing a target, the target having defined thereon a plurality of discrete, identified regions; a plurality of game cards, the game cards having defined thereon a plurality of discrete, identified regions, some or all of which correspond to the plurality of regions on the target; and at least one projectile and means for marking the game cards; and then (b) providing to each player one or more game cards;

(c) establishing an order of play from amongst the players; and (d) selecting a pattern to be formed on the players' game cards in order to win the game; then (e) throwing the projectile at least once toward the target by the first player in the order of play and marking on only that player's game card the region on the target struck by the projectile which matches the region on that player's game card; and then (f) repeating step (e) throughout the order of play, whereby patterns are formed on the players' game cards, until one player has formed the pattern selected in step (d), thereby determining the winner of the game.

2. The method of claim 1, wherein in step (a) a target as shown in FIG. 2 is provided.

3. The method of claim 1, wherein in step (a) a target suitable for use with metal-tipped projectiles and metal-tipped projectiles are provided.

4. The method of claim 1, wherein in step (a) a target suitable for use with plastic-tipped projectiles and plastic-tipped projectiles are provided.

5. The method of claim 1, wherein in step (a) a target and projectiles suitable for use with hook and eye fasteners is provided.

6. The method of claim 1, wherein in step (b) each player is provided a game card by consensus of the other players.

7. The method of claim 1, wherein in step (b) each player is provided a game card by selecting a game card from the plurality of game cards.

8. The method of claim 1, wherein in step (c) the order of play is established by tossing a die.

9. The method of claim 1, wherein in step (c) the order of play is established by each player throwing a single projectile at a selected region on the target, the order of play corresponding to the distance of each player's projectile from the selected region.

10. The method of claim 1, wherein in step (d) the pattern selected in order to win the game comprises five adjacent regions on the game card, the five adjacent regions defining a horizontal, vertical, or diagonal line.

11. The method of claim 1, wherein in step (d) the pattern selected in order to win the game comprises all regions on the game card adjacent to its periphery.

12. A method of playing a game comprising:

(a) providing a dart board having defined thereon twenty wedge-shaped, numbered regions defining a circle, a doubling region and a tripling region intersecting each of the wedge-shaped numbered regions, an outer bull's eye disposed at the center of the circle defined by the wedge-shaped numbered region, and an inner bull's eye inscribed within the outer bull's eye; a plurality of game cards, the game cards having defined thereon a plurality of regions, some or all of which correspond to the plurality of regions on the dart board; a plurality of projectiles and a means for marking the game cards; and then (b) providing to each player one or more game cards;

(c) establishing an order of play from amongst the players; and (d) selecting a pattern to be formed on the players' game cards in order to win the game; then (e) throwing one-at-a-time the plurality of projectiles at the dart board by the first player in the order of play and marking on only that player's game card the regions on the dart board struck by the projectiles which match the regions on that player's game card; and then (f) repeating step (e) throughout the order of play, whereby patterns are formed on the players' game cards, until one player has formed the pattern selected in step (d), thereby determining the winner of the game.

13. The method of claim 12, wherein in step (a) a dart board suitable for use with metal-tipped projectiles and metal-tipped projectiles are provided.

14. The method of claim 12, wherein in step (a) a dart board suitable for use with plastic-tipped projectiles and plastic-tipped projectiles are provided.

15. The method of claim 12, wherein in step (a) a dart board and projectiles suitable for use with hook and eye fasteners is provided.

16. The method of claim 12, wherein in step (b) each player is provided a game card by consensus of the other players.

17. The method of claim 12, wherein in step (b) each player is provided a game card by selecting a game card from the plurality of game cards.

18. The method of claim 12, wherein in step (c) the order of play is established by tossing a die.

19. The method of claim 12, wherein in step (c) the order of play is established by each player throwing a single projectile at the inner bull's eye, the order of play corresponding to the distance of each player's projectile from the inner bull's eye.

* * * * *